US007683548B2

(12) United States Patent
Kupper et al.

(10) Patent No.: US 7,683,548 B2
(45) Date of Patent: Mar. 23, 2010

(54) METHOD OF PRODUCING AN INFRARED LAMP

(75) Inventors: Lukas Kupper, Aachen (DE); Colette Knight, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 463 days.

(21) Appl. No.: 11/571,833

(22) PCT Filed: Jun. 24, 2005

(86) PCT No.: PCT/IB2005/052081

§ 371 (c)(1),
(2), (4) Date: Jan. 9, 2007

(87) PCT Pub. No.: WO2006/006091

PCT Pub. Date: Jan. 19, 2006

(65) Prior Publication Data

US 2008/0031003 A1 Feb. 7, 2008

(30) Foreign Application Priority Data

Jul. 9, 2004 (EP) ..... 04103275

(51) Int. Cl.
*H01J 61/35* (2006.01)

(52) U.S. Cl. ..... 313/635; 362/510; 362/255

(58) Field of Classification Search ..... 313/627–643, 313/567, 111–117, 25–27, 318.01–318.09; 439/615, 739; 445/24, 26, 29, 22; 362/510, 362/464, 255, 293; 89/41.04
See application file for complete search history.

(56) References Cited

U.S. PATENT DOCUMENTS

| | | | | |
|---|---|---|---|---|
| 5,676,579 | A * | 10/1997 | Parham et al. | 445/58 |
| 6,601,980 | B2 * | 8/2003 | Kobayashi et al. | 362/510 |
| 2002/0154515 | A1 | 10/2002 | Yagi et al. | |
| 2003/0007363 | A1 * | 1/2003 | Yagi | 362/510 |

FOREIGN PATENT DOCUMENTS

| | | | |
|---|---|---|---|
| EP | 0686998 | A1 | 12/1995 |
| EP | 0947763 | A2 | 10/1999 |

* cited by examiner

*Primary Examiner*—Peter J Macchiarolo
*Assistant Examiner*—Donald L Raleigh

(57) ABSTRACT

A method of producing an infrared lamp for a vehicle night vision system, where the lamp has a tube which surrounds a radiation source that emits infrared radiation and light radiation. The tube has an infrared-transmitting coating. By setting specific process parameters in the coating process and/or by post-treating the coated tube, holes are formed in an irregular arrangement in the coating. The holes have at least in some areas a defined average size and a defined average surface density.

19 Claims, 3 Drawing Sheets

METHOD OF PRODUCING AN INFRARED LAMP

The invention relates to a method of producing an infrared lamp for a vehicle night vision system. The invention furthermore relates to an infrared lamp produced by means of this method for a vehicle night vision system and also to a headlamp for a vehicle night vision system which comprises such an infrared lamp.

Infrared night vision systems have already been known for a long time in the military and police sector or even for private monitoring and security purposes. In order to increase traffic safety, attempts are being made also to equip civil motor vehicles with suitable night vision systems as an option or even as standard. Such vehicle night vision systems usually consist of a headlamp comprising an infrared radiation source by means of which infrared light is emitted into the relevant area of the traffic space in front of the vehicle, said light being reflected by objects located in the traffic space. The reflected infrared radiation is detected by an infrared-sensitive camera system which is likewise located in the vehicle, for example in the upper region behind the windscreen. Once they have been appropriately processed, the infrared images recorded by said camera system are displayed on a display in the vehicle so that even under poor vision conditions the driver is informed in good time about any objects located in the traffic space. Such vehicle night vision systems are intended for use in particular in situations where the vehicle is not in a position to use full beam in case it dazzles the oncoming traffic. The vehicle night vision system can then be used to cover in particular that region in the traffic space which is further away from the vehicle and thus is not reached by the low beam. In this way, firstly the risk of endangering the oncoming traffic by dazzling it is prevented and secondly the driver can be warned about any objects located in front of the vehicle on the road or directly on the road before these objects pass into the range of the low beam and the driver can see them. By virtue of such an early warning, the time for the driver to react is considerably increased and the likelihood of an accident is thus reduced.

There are various possibilities for generating the infrared radiation for such a vehicle night vision system. Usually, for example, conventional halogen lamps emit infrared radiation in addition to visible light. It is therefore possible to filter out the visible light by means of appropriate infrared-transmitting filters and thus to allow through only the infrared radiation. This may be effected for example by separate filters fitted in the headlamp. In principle, however, it is also possible to apply a suitable IR-transmitting coating directly to the tube of the lamp, which is usually also referred to as the "bulb". However, one considerable problem here is the design of the coating, which should be transparent in the near-IR region to around 800 nm and should filter out the entire visible region from 400 to 800 nm. Since the human eye is sensitive up to a wavelength range of at most around 820 to 830 nm, it would be desirable if a filter could be produced which has a sharp edge in this range.

In practice, infrared-transmitting coatings with such sharp filter edges cannot currently be produced. This means that an amount of visible light below 800 nm is still always transmitted. These light components lie in the red color region. Without additional measures, lamps comprising an IR-transmitting coating thus necessarily also transmit red light. On the other hand, however, for safety reasons it is not permissible to use lamps which produce red light in a vehicle front headlamp since these lamps could be confused with the rear lights or brake lights of the vehicles.

In order to prevent visible red light from also being transmitted through the IR-transmitting coating, it would in principle be possible to shift the filter edge further into the infrared region. Nevertheless, this would necessarily also lead to the infrared radiation being very highly attenuated since such a filter also leads to a filtering-out of part of the IR radiation region. However, for a vehicle night vision system, a relatively high IR radiation intensity is required in order to be able to produce an appropriately good image by means of the night vision equipment.

Another alternative could be to design the filter coating such that it is transparent specifically in a given second spectral region of the visible light, for example in the blue region, so that the light transmitted in this region, mixed with the residual red light passing through the filter, results in white light. However, the design of such filters is extremely difficult and cost-intensive. Since ultimately, however, infrared lamps for use in civil motor vehicles are mass-produced articles, the production costs represent a significant factor for determining how widely used such systems will be in the future.

Another approach which promises success is to ensure, by virtue of appropriate filter designs, that white visible light which is sufficient for masking the emitted red light is additionally emitted. The observer then sees a white lamp and not a red lamp. However, it should be ensured here that the white light is not too bright since dazzling of the oncoming traffic is to be avoided in all cases.

A wide range of designs for solving this problem are described by way of example in U.S. Pat. No. 6,601,980 B2. Besides special headlamp designs in which additional glass cylinders or the like are arranged within the reflector, said glass cylinders being provided with an IR-transmitting coating and completely or partially enclosing the bulb, said document also describes a coating having a uniform pattern of holes which is applied directly to the bulb tube. The diameter and number of holes are selected such that the visible white light passing through the holes is sufficient for masking the amount of red light which is transmitted through the coating.

However, the application of such filigree uniform structures in the coating requires special, complex processes when producing the coating. For example, firstly a filigree mask layer having the desired structure must be applied to the tube surface. The coating must then be applied and the mask then has to be removed again in farther processes. Such additional manufacturing processes are time-consuming and thus increase the production costs of the infrared lamps.

It is therefore an object of the present invention to provide a particularly simple and cost-effective method of producing an infrared lamp for a vehicle night vision system and also a corresponding infrared lamp which during operation in the headlamp of a vehicle night vision system does not appear to be red.

In the method according to the invention, a tube which is preferably made of quartz glass and surrounds a radiation source that emits infrared radiation and light radiation is provided with an IR-transmitting filter coating. By setting specific process parameters directly in the coating process and/or by post-treating the coated tube, it is ensured that holes form in an irregular arrangement in the coating, which holes have at least in some areas a defined, that is to say predetermined, average size and a defined average surface density. Unlike in the aforementioned infrared lamp according to the prior art, the infrared lamp according to the invention therefore does not have a coating with a uniform defined pattern but rather the coating has holes in an irregular or random arrangement, wherein the holes may be irregularly shaped defects, cracks, etc.

In a wide range of experiments, it has surprisingly been found that, by setting specific process parameters during the coating operation itself or by post-treating the coated tube in a non-complex manner, it is possible in a simple manner to regulate whether, and if yes how many, holes will occur in certain areas in the coating and what the average size of these holes will be. There is then no need for any expensive and complicated additional processes for making defined patterns in the coating.

Further advantageous refinements and embodiments of the invention emerge from the further claims and from the description.

The radiation source may be a single radiation source, such as for example a coil in a halogen lamp, which simultaneously emits infrared radiation and light radiation. In principle, however, it may also be a radiation source consisting of a number of partial radiation sources, wherein one partial radiation source emits infrared radiation and the other partial radiation source emits light radiation. A lamp having two different coils is conceivable here for example. For cost reasons, however, it is more advantageous to use a bulb having just one radiation source which simultaneously emits infrared radiation and light radiation. Moreover, the radiation source may in principle be any type of radiation source. In particular, it need not necessarily be a coil but rather use may also be made for example of a discharge lamp in which the radiation source is an appropriate arc or the like. The tube may be the glass tube which directly surrounds the radiation source. If the lamp is a lamp which has two tubes on top of one another—one inner tube and one outer tube—such as a gas discharge lamp for example, the coating is preferably (but not necessarily) located on the outer tube.

In principle, by appropriately setting the process parameters in the coating process or in the post-treatment process, it can be ensured that the average size and the average surface density are essentially selected such that the light radiation passing through the holes during operation of the lamp already has a sufficient intensity to mask an amount of visible red light which is transmitted through the IR-transmitting coating.

However, in order to keep the number of deliberately produced holes, i.e. defects or cracks, in the coating low, preferably certain part-regions of the tube which are suitable for this purpose additionally remain without the infrared-transmitting coating. In this case, the average size and average density of the holes in the coating are selected such that the light radiation passing through the holes during operation of the lamp, together with the light radiation passing through the coating-free part-regions of the tube, has a sufficient intensity to mask an amount of visible red light which is transmitted through the IR-transmitting coating. With particular preference, the pinch area and/or a sealed tip of the tube for example remain free of the infrared-transmitting coating. In terms of the method, it is relatively simple to keep such end regions of the lamp free of a coating or to subsequently free them of the coating. Preferably, the lamp is held in a holder during the coating process, and said holder has suitable means for screening off the desired end region(s) so that these regions are not coated. Alternatively, the coating may also be subsequently removed in a dipping bath or the like. Usually, in most lamp designs, the visible light exiting through the sealed tip and/or through the pinch would not alone be sufficient to reliably mask the residual red light, particularly since this light impinges only in very precise spatial areas. Combined with the holes which according to the invention are produced in a simple manner in the coating, however, it is overall possible in a cost-effective manner to produce a lamp which emits sufficient infrared light and in which the white light passing through the holes in the coating and through the coating-free regions such as the pinch regions and/or sealed tip is sufficient to mask the residual amount of red light. In particular, the spatial distribution of the light is also optimal for reliable masking without further complex structures in the reflector.

The infrared-transmitting coating used is preferably a multilayer coating in which a number of coating layers are applied one on top of the other to the tube, wherein the coating layers in each case have a different refractive index. For example, a layer having a high refractive index and a layer having a low refractive index are applied alternately. Usually, such a filter coating consists of around 20 to at most around 50 layers. Suitable materials for this are, for example, Si and $SiO_2$. Silicon is a highly refractive substance having a refractive index of around 3, whereas $SiO_2$ is a material having a low refractive index of around 1.4. When different layers having different refractive indices are alternated, the interference effect ensures that individual wavelengths are amplified and other wavelengths are blocked. Moreover, radiation in the visible region is absorbed by the Si layers. Overall, by suitably selecting appropriate materials having appropriate refractive indices and by suitably selecting the layer thicknesses in the range from around 50 to around 160 nm, it can be ensured that precisely the desired filter characteristic is achieved. Other highly refractive materials which may be used for the layers are $TA_2O_5$, $TiO_2$, $ZrO_2$ and ZnS. Besides the aforementioned $SiO_2$, possible low-refractive layers also include $MgF_2$ or $AlF_6$. The various possibilities are known to the person skilled in the art.

The layers may be applied for example by means of vapor deposition. In this case, the material which is to be applied as a layer to the tube is evaporated in vacuo within an evaporation chamber at a temperature of around 1000 Kelvin for example. The vaporized material then precipitates on the surface to be coated.

Another alternative is the process known as "sputtering". This involves spraying a surface. This process also takes place in a chamber under vacuum conditions. A target is required which is made of the material to be deposited. By bombarding this target with high-energy particles, usually ions, some of the particles from the target pass into a vapor phase. Alternatively, the energy for vaporizing the target material can also be introduced into the target by means of microwave radiation. The particles in the vapor phase pass onto the surface to be coated and precipitate there.

Both processes are known to the person skilled in the art and therefore do not need to be explained in detail here. One essential difference in the two processes is that vapor-deposited layers are usually less dense and have lower internal stresses than sputtered-on layers. Very dense layers having a relatively high refractive index can be produced by sputtering. These layers are very stable and there is usually no diffusion or only very slight diffusion between the individual layers which have been sputtered on one after the other.

Various methods have proven suitable for making holes in the coating which have at least in some areas a defined average size and a defined average surface density.

A first preferred method consists in that the coated tube or the coated lamp is subjected to a defined heating process until the desired holes having the defined average size and average surface density have formed in the coating. In this method, the lamp with the coating is kept at a given temperature for a given period of time.

This method is particularly suitable for multilayer coatings which have been applied by means of a sputtering process, particularly preferably by means of a microwave sputtering process. In a wide range of test series, it has been found that such layers are particularly suitable for making the holes in subsequent defined thermal heating processes. The reason for this is that the different layers within the coating have different thermal expansion coefficients and the desired cracks and defects occur during subsequent heating on account of the high density and the stresses created during the sputtering process. The number of holes and average size of the holes depends in this case both on the heating time and on the temperature.

However, depending on the desired surface density of the holes and the maximum average diameter, it is also possible under some circumstances to treat coatings applied by vapor-deposition processes by means of appropriate subsequent thermal processes so that the desired holes having the defined surface density and average size are produced.

Preferably, the coated tube or the lamp is kept at a given minimum temperature at least until the number and average size of the holes no longer changes significantly. It has been found that a type of saturation effect occurs after a certain time at a given temperature. The stresses within the coating are then largely broken down and the number and average size of the holes no longer changes significantly.

The process parameters during the coating operation and in the subsequent process are advantageously selected such that, after the targeted heat treatment, no more holes are produced by other external or internal influences of the lamp, for example by the heating of the lamp during normal operation, as this would subsequently change the defined average surface density and average size of the holes that has been set.

Another alternative for making holes having a defined average size and average surface density is to set the vacuum, i.e. the low pressure, when the coating is applied by sputtering or vapor-deposition. It has been found in further experiments that defects can likewise deliberately be made in the coating by increasing the pressure compared to the pressure which is usually set for the normal coating operation. Whereas the normal vapor-deposition or sputtering process is carried out at pressures of 3 to 6 mTorr, sufficient defects can be produced in the coating by increasing the pressure to around 7 to 11 mTorr. In one example of embodiment, 34 layers of Si and $SO_2$ were applied in a vapor-deposition process at a pressure of 8 mTorr. An average surface density of 10 to 20 was achieved, while the holes had an average size of 3-4 μm.

It has been found in a number of test series that, when using a lamp, preferably an H7 lamp, in which the pinch area and/or the sealed tip is uncoated, the average size of the holes should preferably be between 1 and 20 μm, particularly preferably between 2 and 8 μm. The average surface density should preferably be approximately 10 to 40 holes/$mm^2$, particularly preferably between 15 and 25 holes/$mm^2$. It should be expressly pointed out once again that these are mean data. Thus, for example, given an inhomogeneous temperature distribution during heating of the lamp, considerable fluctuations in terms of density and size distribution may occur, so that a much greater surface density with a higher average size of the holes is achieved in one region of the lamp, e.g. close to the coil, than in other regions.

On the whole, the average size and average surface density of the holes in the coating and possibly the coating-free part-regions of the tube should essentially be designed and/or arranged such that the light radiation exiting through the holes and possibly the uncoated part-regions during operation of the lamp, mixed with the amount of visible red light which is transmitted through the infrared-transmitting coating, results overall in light in the ECE white region. In other words, the spectral ratio of the emitted light as a whole should essentially be white in accordance with ECE standard R112/R113. It should preferably be ensured that, when the light is emitted from the vehicle headlamp in which the lamp is finally used, in the emission direction the light in the ECE white region is less than 60 candela. In this way, dazzling of the oncoming traffic is reliably prevented, so that the lamp can be used even when full beam is not permitted for dazzling reasons.

The invention will be further described with reference to examples of embodiments shown in the drawings to which, however, the invention is not restricted. In the figures, the same components are in each case denoted by identical references.

Figure 1:
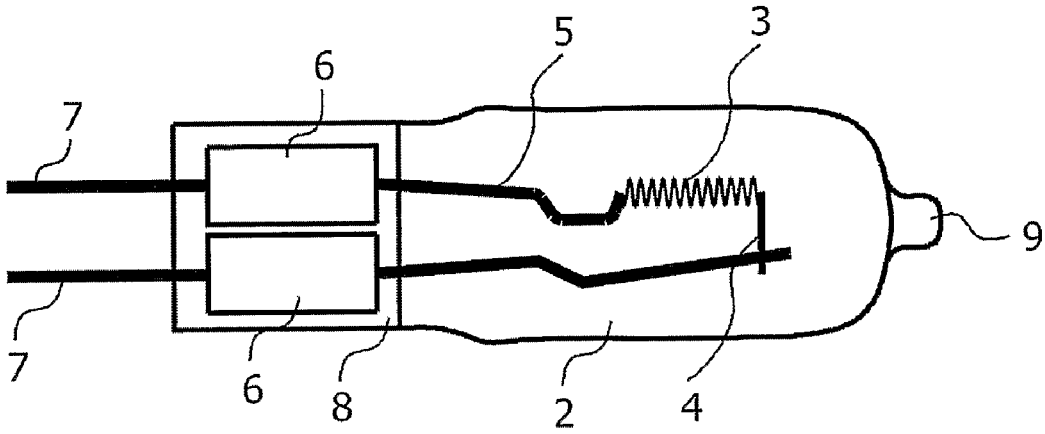
FIG. 1 prior art
FIG. 1 shows a schematic diagram of a halogen lamp according to the prior art.

FIG. 1 shows a schematic diagram of a conventional halogen lamp according to the prior art. By way of example, the so-called H7 bulbs are constructed in this way. The radiation source used here is a coil 3 which is held by two electrodes 4, 5. The coil 3 with the electrodes 4, 5 is surrounded by a glass tube 2 which is filled with a conventional halogen gas. Located at the end of this tube 2 is the so-called lamp tip or sealed tip 9 which is caused by the manufacturing process. The electrodes 4, 5 are fixed to thin metal foils 6 in a so-called pinch area 8. Fixed to these metal foils 6 are supply lines 7 which at the other end pass towards the outside. This line transfer via the metal foils 6 takes place for sealing reasons. Using its pinch area 8 as a base, the lamp 7 can be inserted in a holder provided for such bulbs, wherein the supply lines 7 are pushed into suitable connector contacts. During operation, a voltage of around 12-14 V is usually applied to the coil 3, and as a result the coil 3 begins to glow. Both infrared radiation and visible light are then emitted from the lamp.

Figure 2:
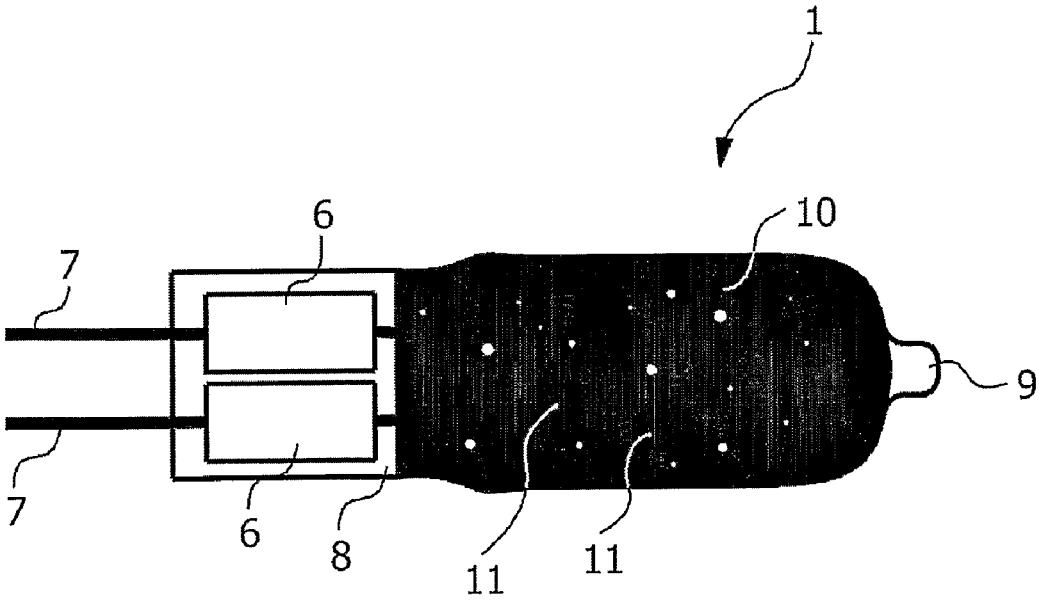
FIG. 2 shows a schematic diagram of the halogen lamp of FIG. 1, but with the coating according to the invention.

According to the invention, such a lamp 1 is provided with a coating 10 as shown in FIG. 2. This coating 10 has holes 11 in an irregular, random arrangement, for example irregularly shaped defects or cracks. In the illustrated example of embodiment, only the central region of the lamp tube 2 is provided with the coating 10. The sealed tip 9 and the pinch 8 have not been coated.

Figure 3:
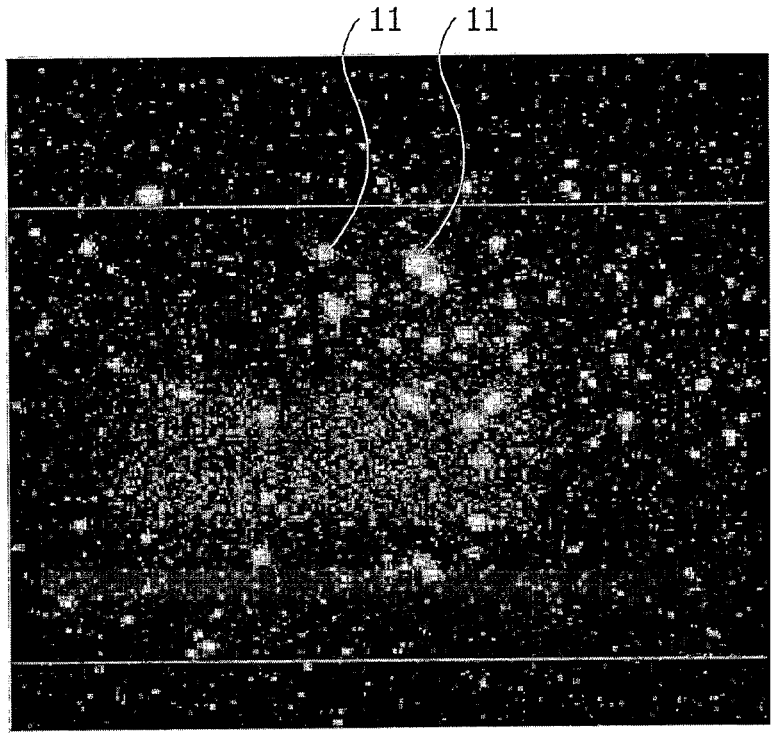
FIG. 3 shows a microscope image of a coating according to the invention on a lamp surface, according to a first example of embodiment.
Figure 4:
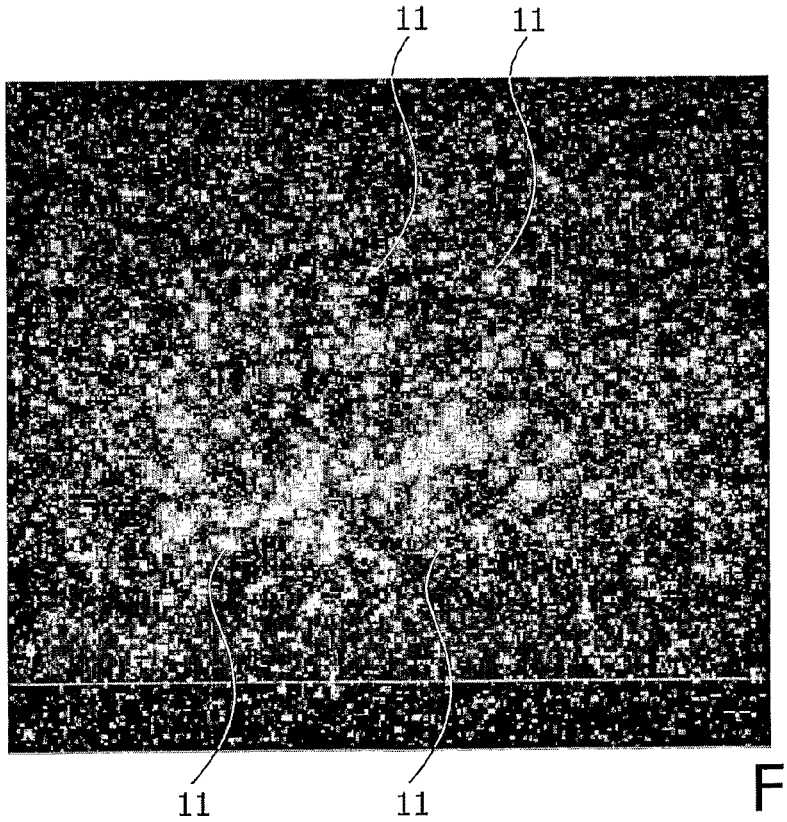
FIG. 4 shows a microscope image of a coating according to the invention on a lamp surface, according to a second example of embodiment.

FIGS. 3 and 4 in each case show microscope images of part of the coating 10, on which the holes 11 can clearly be seen. It can also be seen here that these holes 11 occur in an irregular manner, are irregularly shaped and are of different size.

These holes 11 are produced by setting specific process parameters during the coating operation or in a post-treatment process following the coating operation, wherein the surface density and/or average size are precisely defined by selecting suitable parameters. FIG. 3 shows part of a coating 10 with a surface density and average size of the holes 11 distributed relatively uniformly over the entire surface. FIG. 4 on the other hand shows part of a coating 10 in which, by suitably selecting the process parameters and/or by virtue of the type of post-treatment process, it has been ensured that a higher surface density and greater average size of the holes 11 occurs in certain regions, whereas in other regions there is a lower hole density and smaller average size of the holes 11.

In both cases, these are multilayer coatings with alternating Si and $SiO_2$ layers. The layers have in each case been applied in a so-called MicroDyn sputtering process. This process is a sputtering process in which the plasma is produced not by particle bombardment but rather by microwaves. As a result, even higher densities and higher refractive indices can be achieved than in the conventional ion-assisted vapor-deposition of layers. In particular, there is no diffusion between the individual layers. These lamps coated in this way have then been exposed to a defined thermal post-treatment process.

Figure 5:
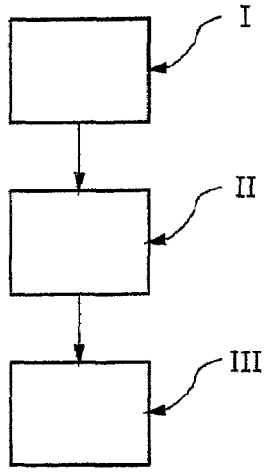
FIG. 5 shows a schematic diagram of a process for producing the infrared lamp according to the invention.

The process of producing such a lamp 1 is shown once again in FIG. 5 in the form of a flow chart. In a first process step I, a bulb is produced in a conventional manner, for example an H7 halogen bulb as shown in FIG. 1. In process step II, this bulb is then coated. Regions of the lamp which are to be left free of the coating are preferably covered by the lamp holder during the coating operation. In a further process step III, the desired holes are then produced with the defined average surface density and with a defined average size.

In the examples of embodiments shown in FIGS. 3 and 4, the coatings have in each case been heated for 100 hours by a heating device, wherein the temperature is above 600° C. It has been found that at a temperature of 650° C. the number of holes no longer significantly increases after 100 hours. Since the temperature of 650° C. is also above the maximum temperature which can be reached on the tube during operation of the lamp, with these parameters it is also ensured that the holes do not inadvertently expand or the number of holes does not increase during subsequent operation.

For most use purposes, it is sufficient to produce a uniform density distribution and average size as shown in FIG. 3. In principle, however, it is also possible to produce different hole densities and average sizes in some areas, as shown in FIG. 4. For example, a higher hole density may be achieved in the region of the coil than in the other regions if, in addition or as an alternative to external heating, the coil itself is made to glow and thus the temperature of the tube is increased in a targeted manner at this location. FIG. 4 shows the effect after 100 hours of heating by the coil, wherein a temperature of on average 650° C. has likewise been reached in the tube. Since, however, glowing of the coil in the post-treatment process would automatically also lead to a reduction in the service life of the subsequent lamp, purely external heating in a heating device is the preferred measure.

It has been found that the thermal post-treatment of the coating does not have any negative effects on the reflection spectrum. The filter edge is merely shifted towards lower wavelengths.

The coating should therefore preferably be built up such that the filter edge of the coating lies in the range from 830 to 880 nm at an operating temperature of the lamp. The number and size of the holes made is then sufficient to compensate the residual red light in the run-up phase of the lamp. Preferably, the filter edge should lie in the range from 730 to 780 nm in the "cold" state of the lamp. The coating on the lamp reaches a temperature of 600-700° C. approximately three minutes after switch-on. In the process, the filter edge is shifted by 100 nm into the desired range of 830 to 880 nm.

Figure 6:
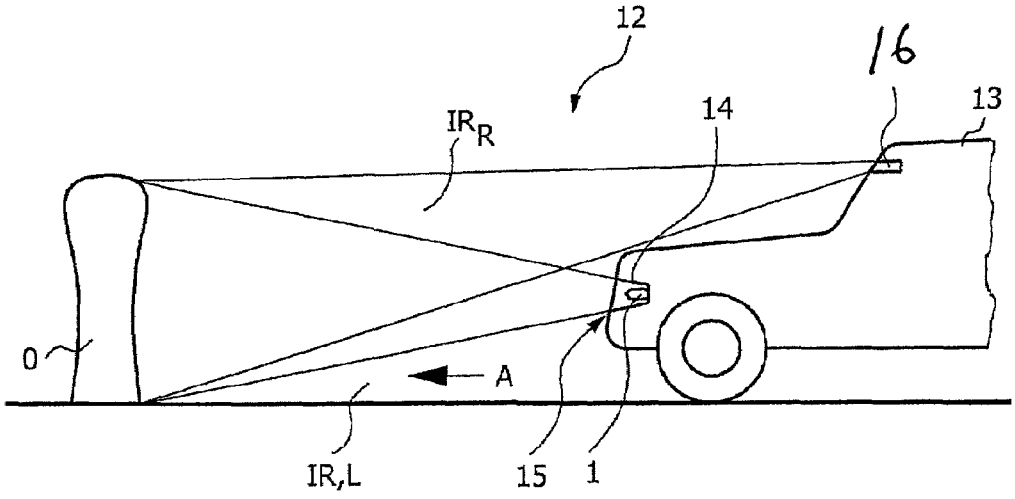
FIG. 6 shows a highly schematic diagram of a motor vehicle night vision system.

FIG. 6 shows in a highly schematic manner a motor vehicle night vision system 12 in which an infrared lamp according to the invention can be used. The front part of a motor vehicle 13 is schematically shown here. The IR lamp 1 according to the invention is placed in a conventional reflector 14 within a headlamp 15. Of course, the vehicle 13 also has other conventional lamps and headlamp systems such as full beam, low beam, fog lights, etc.

The IR light IR exiting from the infrared lamp 1 according to the invention is emitted via the reflector 14 out of the headlamp 15 in the emission direction A into the traffic space and strikes any object O located in said traffic space. This object O reflects the IR radiation. The reflected IR radiation $IR_R$ is detected by an infrared-sensitive camera system 16 which is located in the vehicle 13 for example at the top behind the windscreen. In principle, the IR-sensitive detector used may be a normal CCD or CMOS camera. Such cameras are IR-sensitive anyway, and for use in normal cameras have an IR filter which need only be removed for use in a night vision system. Preferably, a camera system 16 comprising two cameras at a distance from one another may be used in order to be better able to detect spatial information. After suitable processing, the images recorded by the IR camera system 16 can then be displayed to the driver of the motor vehicle 13 on a display (not shown). Automatic evaluation of the data is also possible, so that the driver is notified about objects O located on the road for example by means of acoustic signals or light signals.

In one particularly preferred example of embodiment, in such a motor vehicle night vision system use is made of a lamp 1—as shown in FIG. 2—which does not have any coating in the pinch area 8 and in the region of the sealed tip 9 but is provided with the coating 10 on all of the rest of its surface, said coating having the holes 11 according to the invention. The average surface density of the irregularly occurring holes and the average size thereof are set such that the visible light passing through the holes and the pinch and the sealed tip, together with the amount of visible red light passing through the infrared-transmitting coating, has a spectrum which essentially has a color in the ECE white region. Moreover, the hole size and hole density and the regions left free of the coating in the pinch area and at the sealed tip are selected such that the white light L emitted into the traffic space in the emission direction A is less than 60 candela, particularly preferably less than 50 candela.

Finally, it should be pointed out once again that the methods and lamps shown in the figures and in the description are merely examples of embodiments which can be widely varied by the person skilled in the art without departing from the scope of the invention. For example, further method steps may be added to the method sequence described in detail. Moreover, it should be pointed out for the sake of completeness that the use of the indefinite article "a" or "an" does not rule out the fact that the relevant features may also be present a number of times and that the use of the term "comprise" does not rule out the existence of further elements or steps.

The invention claimed is:

1. A method of producing an infrared lamp for a vehicle night vision system comprising the acts of:

surrounding a radiation source that emits infrared radiation and light radiation with a tube;

providing an infrared-transmitting coating on the tube including setting specific process parameters in a coating process and/or post-treating the coated tube so that holes form in an irregular arrangement in the infrared-transmitting coating.

2. The method as claimed in claim 1, wherein an average size and the average distribution of the holes are selected such that the light radiation passing through the holes during operation of the lamp has a sufficient intensity to mask an amount of visible red light which is transmitted through the infrared-transmitting coating.

3. The method as claimed in claim 1, wherein certain part-regions of the tube remain without the infrared-transmitting coating and an average size and average distribution of the holes in the coating are selected such that the light radiation passing through the holes during operation of the lamp, together with the light radiation passing through the coating-free part-regions of the tube, has a sufficient intensity to mask an amount of visible red light which is transmitted through the infrared-transmitting coating.

4. The method as claimed in claim 3, wherein the average size of the holes is of between 1 and 20 μm, and the average distribution is approximately 10 to 40 holes per $mm^2$.

5. The method as claimed in claim 1, wherein an average size and average distribution of the holes in the coating and the coating-free part-regions of the tube are arranged such that the light radiation exiting through the holes and the uncoated part-regions during operation of the lamp, mixed with an amount of visible red light which is transmitted through the infrared-transmitting coating, results in light which is white.

6. The method as claimed in claim 1, wherein the providing act includes applying a number of coating layers on top of one another.

7. The method as claimed in claim 1, wherein the coating layers are applied by a sputtering process.

8. The method as claimed in claim 1, further comprising the act of subjecting the coated tube to a defined heating process until a number and an average size of the holes no longer change.

9. The method as claimed in claim 8, wherein the coated tube is kept at a minimum temperature at least until the number and the average size of the holes no longer change.

10. The method as claimed in claim 1, wherein, during the providing act, a defined vacuum is set such that the holes form in the coating.

11. The method as claimed in claim 1, providing act includes building up the coating to form a filter having a pass-band frequency between filter edges such that one filter edge of the filter edges lies in the range from 830 to 880 nm at an operating temperature of the lamp.

12. An infrared lamp for a vehicle night vision system comprising:

a radiation source which emits infrared radiation and light radiation, a tube which surrounds the radiation source, and an infrared-transmitting coating which is applied to the tube and which has an irregular arrangement of holes.

13. A headlamp for a vehicle night vision system, comprising an infrared lamp as claimed in claim 12.

14. A headlamp as claimed in claim 13, wherein an average size and an average distribution of the holes in the coating and uncoated part-regions of the tube are designed such that the light radiation exiting through the holes and the uncoated part-regions during operation of the lamp, mixed with the amount of visible red light which is transmitted through the infrared-transmitting coating, results in white light, wherein the light intensity when the light is emitted from the vehicle headlamp in an emission direction is less than approximately 60 candela.

15. The use of an infrared lamp as claimed in claim 12 for a motor vehicle night vision system.

16. The method as claimed in claim 1, wherein an average size of the holes is of between 2 and 8 μm, and an average distribution of the holes is approximately 15 to 25 holes per $mm^2$.

17. The method as claimed in claim 1, wherein the holes are formed by heating the coating by an inhomogeneous temperature distribution.

18. The method as claimed in claim 1, wherein the holes are formed by heating the coating and turning on the lamp so that a greater distribution of holes with a higher average size is achieved in a region of the lamp where the lamp is hotter than in other regions of the lamp.

19. The method as claimed in claim 1, wherein the providing act includes targeted heating of one region of the lamp so that a greater distribution of holes with a higher average size is achieved at the one region of the lamp where the lamp is hotter than in other regions of the lamp.

* * * * *